US007484395B2

(12) United States Patent
Bosch

(10) Patent No.: US 7,484,395 B2
(45) Date of Patent: Feb. 3, 2009

(54) DELIVERY GUIDE ASSEMBLY HAVING A MOVEABLE CAM

(75) Inventor: Ernesto Bosch, Rock Hill, SC (US)

(73) Assignee: Dynamic Mill Services Corporation, Rock Hill, SC (US)

( * ) Notice: Subject to any disclaimer, the term of this patent is extended or adjusted under 35 U.S.C. 154(b) by 66 days.

(21) Appl. No.: 11/671,550

(22) Filed: Feb. 6, 2007

(65) Prior Publication Data

US 2008/0184759 A1 Aug. 7, 2008

(51) Int. Cl.
*B21B 39/20* (2006.01)

(52) U.S. Cl. ..... 72/250; 72/428; 72/452.4

(58) Field of Classification Search ..... 72/250, 72/227, 428, 482.1–482.5, 452.4, 314, 315
See application file for complete search history.

(56) References Cited

U.S. PATENT DOCUMENTS

| | | | | |
|---|---|---|---|---|
| 1,085,353 | A | | 1/1914 | Miller |
| 1,388,290 | A | | 8/1921 | Nelson |
| 1,428,765 | A | | 9/1922 | Elmendorf |
| 1,620,566 | A | * | 3/1927 | Mercer ..... 193/1 |
| 1,936,672 | A | | 11/1933 | Iversen et al. |
| 2,039,169 | A | | 4/1936 | Kearns et al. |
| 2,264,218 | A | * | 11/1941 | O'Malley ..... 72/250 |
| 2,540,887 | A | | 2/1951 | Hyatt |
| 2,602,358 | A | | 7/1952 | Lile |
| 2,878,697 | A | | 3/1959 | Krause |
| 3,798,952 | A | | 3/1974 | Easter |
| 4,667,561 | A | | 5/1987 | Storey et al. |

FOREIGN PATENT DOCUMENTS

| | | |
|---|---|---|
| DE | 1078073 | 3/1960 |
| FR | 2366072 | 4/1978 |
| GB | 436743 | 10/1935 |
| GB | 1350598 | 4/1974 |

OTHER PUBLICATIONS

European Search Report Issued May 15, 2008.

* cited by examiner

*Primary Examiner*—Dana Ross
*Assistant Examiner*—Debra M Sullivan
(74) *Attorney, Agent, or Firm*—Summa, Additon & Ashe, P.A.

(57) ABSTRACT

The present invention provides a guide assembly for use in processing a work piece with features that incorporate a cam-style locking clamp to promote ease of use in securing and releasing a guide of the assembly. In more specific embodiments, the invention is a delivery guide assembly for use in, for example, a rolling mill for processing steel and steel rods that promotes rapid removal of a delivery stripper and addresses the problems identified with known delivery guide assemblies.

18 Claims, 2 Drawing Sheets

DELIVERY GUIDE ASSEMBLY HAVING A MOVEABLE CAM

BACKGROUND OF THE INVENTION

This invention relates generally to a mechanism for guiding a work piece from one station to another in a material processing operation. Specifically, the invention relates to a delivery guide assembly for use in a rolling mill.

During a hot rolling process in a steel mill, a billet of hot steel (i.e., a work piece) is gradually reduced into a bar or rod of desired cross-sectional dimension and configuration. The reduction of the bar is accomplished by passing the unfinished steel through a plurality of rolling mill stands each having a pair of opposed grooved rollers for forming the bar. The rolling mill stands typically include a series of guide assemblies for guiding the bar to and from the grooved rollers. The delivery guide assembly typically includes a delivery holder, and a delivery guide or stripper for directing and processing the bar, wherein the delivery stripper is secured by the delivery holder.

As the bar travels through successive stands it must be guided into and out of the grooves on the opposed rollers. Improper alignment of the bar can result in a "cobble." The term cobble refers to a mass of hot deformed bar at the point of initial failure and at upstream locations. The cobble results in a blockage in the in-line process and prevents continuation of the hot rolling process. Accordingly, the cobble must be cooled, cut, and removed prior to continued mill operations. Unfortunately, the mill remains shut down until the cobble is removed from, for example, the delivery guide assembly. Discontinuation of the mill operations results in economic losses borne by the manufacturer.

Known devices for securing the delivery stripper to a base include bolts that are tightened to produce the force necessary to secure the delivery stripper to the delivery holder. Other known devices include impact wedge assemblies that are moveable to create the force necessary to secure the delivery stripper to the delivery holder.

The known delivery guide assemblies fail to provide a means for readily removing delivery strippers from the delivery holder. For example, the bolts must be manually loosened and removed which can be time consuming when the cobble settles on a portion of the bolt. In another example, the impact wedge assemblies are typically positioned on the delivery guide assembly to prevent ready access for removal. Stated differently, a worker must manually strike the wedge assemblies at angles that are not conducive to ready removal. Accordingly, there exists a need for a delivery guide assembly that better provides for the ready removal of delivery strippers from the delivery holder.

SUMMARY OF THE INVENTION

The present invention provides a guide assembly for use in processing a work piece with features that promote ease of use in securing and releasing a guide of the assembly. In more specific embodiments, the invention is a delivery guide assembly for use in, for example, a rolling mill for processing steel and steel rods that promotes rapid removal of a delivery stripper and addresses the problems identified with known delivery guide assemblies.

In one embodiment, the invention is a guide assembly for use in processing a work piece having a holder, a guide for directing the work piece from one station to another station, and a movable cam releasably attached to the holder. The guide is releasably secured to the holder by the movable cam.

The cam is movable between a disengaged position to release the guide from the holder and an engaged position to secure the guide to the holder. This embodiment may further provide that the holder has a bottom member, a pair of side members that extend upward from the bottom member, and a mounting member that connects upper portions of the side members and supports the movable cam. As configured, the guide is releasably secured between the bottom member and the mounting member. The concept of a component being "between" two other components does not necessarily imply that the three components are contiguous (i.e., in intimate contact). Rather, as used herein, the concept of one component being between two other components is meant to describe the relative positions of the components within the assembly structure, respectively.

In another embodiment, the invention is a delivery guide assembly that includes a delivery stripper secured to a delivery holder by a cam-style locking clamp. As the locking cam is rotated, it applies a force on the upper surface of the delivery stripper to secure the stripper to the base. Variations of this embodiment of the assembly are disclosed that include one or more additional components, such as a base to support the delivery holder and delivery stripper, a lever arm attached to the cam-style locking clamp and used to facilitate the operation of the locking clamp, and a wedge serving as an upper restraint for the delivery stripper.

In yet another embodiment, the invention is a delivery guide assembly for use in a rolling mill having a delivery holder, a delivery stripper releasably secured to the delivery holder, and a movable striker cam pivotally mounted on the delivery holder that releasably secures the delivery stripper to the delivery holder. A base is provided to support the delivery holder and the delivery stripper. Also provided in this embodiment is a locking wedge positioned between the striker cam and the delivery stripper.

In this embodiment, the rotation of the striker cam imparts a compression force through the locking wedge to the delivery stripper to secure the stripper to the delivery holder. The delivery holder may include a bottom member, a pair of opposing side members extending from the bottom member, and a striker cam mounting member position between the opposing side members such that the mounting member engages the striker cam. As configured, the delivery stripper is releasably secured to the delivery holder within a space defined by the bottom member, the opposing side members, and the striker cam mounting member.

The invention provides, among other benefits, a delivery guide assembly that facilitates the ready removal of a delivery stripper in the event of cobbling. In particular, the combination of the moveable cam and movable wedge that secures and releases the delivery stripper promotes the efficient repair of a delivery guide assembly during cobbling and minimizes downtime for repairs during steel rolling operations.

BRIEF DESCRIPTION OF THE DRAWINGS

The foregoing and other objects and advantages of the invention and the manner in which the same are accomplished will become clearer based on the following detailed description taken in conjunction with the accompanying drawings.

DETAILED DESCRIPTION OF THE INVENTION

The invention will now be described more fully hereinafter with reference to the accompanying drawings. This invention may, however, be embodied in different forms and should not be construed as limited to the embodiments set forth herein. Rather, these embodiments are provided so that this disclosure will be thorough and complete and will fully convey the scope of the invention to those skilled in the art. Like numbers refer to like elements throughout.

Figure 1:
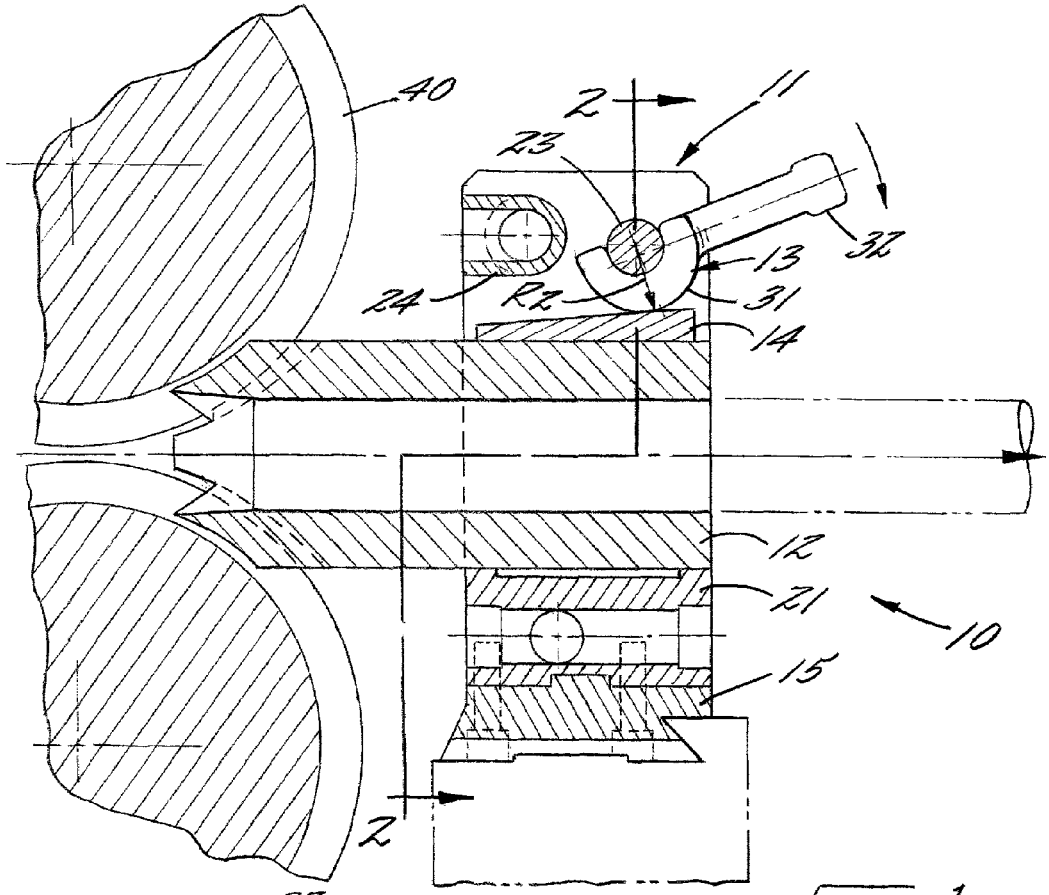
FIG. 1 is partial cross-sectional side view of one embodiment of the delivery guide assembly of the invention.

FIG. 1 shows a partial cross-sectional side view of one embodiment of the assembly, shown generally at 10. In the embodiment depicted, the structure of the delivery guide assembly 10 is generally defined by a delivery holder 11 mounted on a base 15. The delivery stripper 12 is secured to the delivery holder 11, and serves to guide a work piece to or from a series of rollers 40. The delivery stripper 12 is secured to the delivery holder 11 by a locking wedge 14 adjacent to the delivery stripper used in conjunction with a movable striker cam 13 mounted to the delivery holder 11. A top member 24 of the delivery holder 11 provides stiffness to the delivery holder 11, and may further be used to connect other components in the rolling mill to the delivery guide assembly 10.

The striker cam 13 includes a substantially semi-circular engaging member 31 that secures the striker cam 13 to a mounting member 23 on the delivery holder 11. The striker cam 13 also includes a lever arm 32 extending from the engaging member 31, which serves to provide mechanical assistance for the operation of the striker cam 13. The movement of the lever arm 32 causes the striker cam 13 to rotate about the mounting member 23 between a disengaged position and an engaged position. The rotation of the striker cam 13 to the engaged position imparts a compressive force on the locking wedge 14, which translates the compressive force to the delivery stripper 12.

Figure 2:
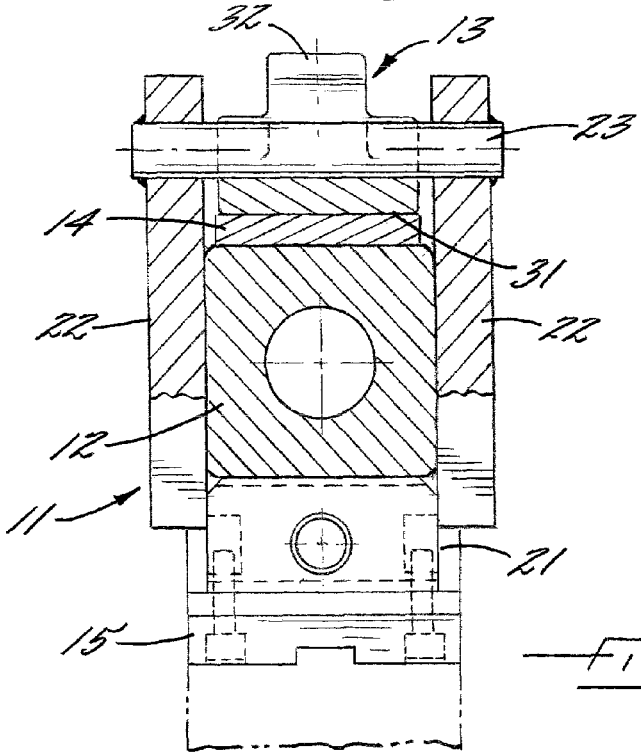
FIG. 2 is an enlarged transverse sectional view of one embodiment of the delivery guide assembly taken generally along line 2-2 of FIG. 1.

FIG. 2 shows an enlarged transverse sectional view of this embodiment of the delivery guide assembly 10 having a delivery holder 11 mounted on a base 15. As is shown in this figure, the delivery holder 11 is composed of a bottom member 21 and a pair of side members 22 extending upward from the bottom member 21. The mounting member 23 is secured to each of the side members 22, thereby connecting the upper free ends of the delivery holder 11. The striker cam 13 rotates about the mounting member 23, applying pressure to the locking wedge 14 to secure the delivery stripper 12 between the locking wedge 14 and the bottom member 21, and between the side members 22.

Figure 3:
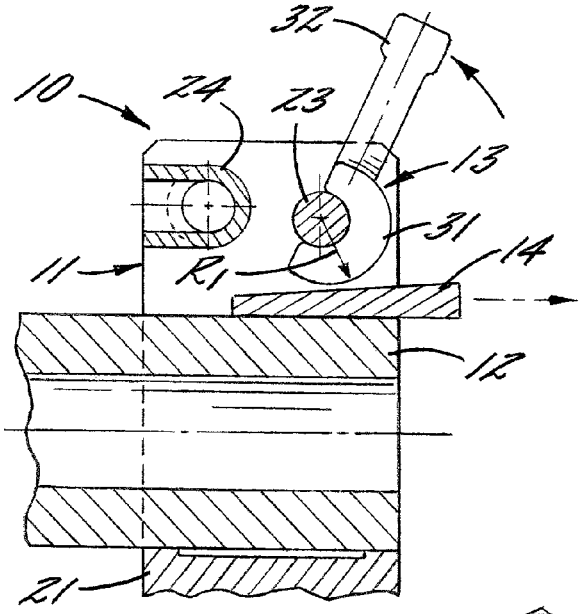
FIG. 3 is a partial cross-sectional side view of one embodiment of the delivery guide assembly illustrating rotation of the cam and movement of the wedge.

FIG. 3 is a partial cross-sectional side view of one embodiment of the delivery guide assembly 10. The movement of the lever arm causes a rotation of the striker cam 13 from an engaged position to a disengaged position. This movement allows the locking wedge 14 to be removed from the delivery holder 11, which accordingly releases the delivery stripper 12 from its fixed position against the delivery holder 11.

Figure 4:
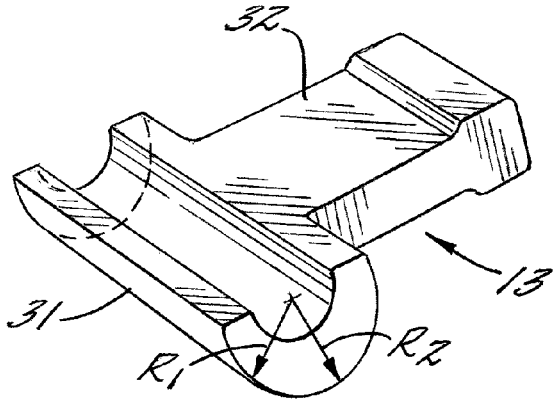
FIG. 4 is an enlarged perspective view of one embodiment of the cam showing the varying outer radius along an outer circumference of the engaging member of the cam.

FIG. 4 is an enlarged perspective view of one embodiment of the striker cam 13. As is shown in this figure, the engaging member 31 of the striker cam 13 has an outer radius varying along the outer circumference of the engaging member 31. This outer radius varies between a first radius R1 corresponding to a disengaged position of the striker cam 13 and a second radius R2 corresponding to an engaged position. By this structure, the increasing radius relative to adjacent objects caused by the rotation of the striker cam 13 is thereby translated into a lateral force.

Figure 5:
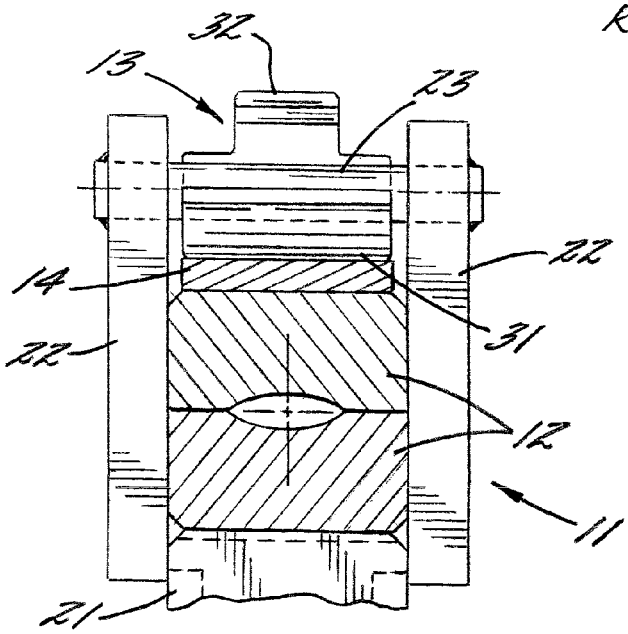
FIG. 5 is an enlarged side elevation view of another embodiment of the delivery stripper of the delivery guide assembly.

FIG. 5 is an enlarged side elevation view of another embodiment of the delivery stripper 12 of the delivery guide assembly 10. In this embodiment pictured, the delivery stripper 12 is formed of two pieces. The separate pieces are secured together and secured between the side members 22 and a bottom member 21 of the delivery holder 11 and the locking wedge 14. As with previous embodiments, the rotation of the striker cam 13 mounted to the mounting member 23 on the delivery holder 11 presses the locking wedge 14 against the delivery stripper 12, thereby securing it to the delivery holder 11.

In one embodiment, the invention is a guide assembly 10 for use in processing a work piece. The guide assembly 10 includes a holder 11, a guide 12 for directing the work piece from one station to another station, and a movable cam 13 mounted on the holder 11. For instance, the guide 12 may be an entry guide for feeding a steel bar to a pair of grooved rollers 40, or the guide 12 may be a delivery stripper for guiding a steel bar from a pair of grooved rollers 40. The guide 12 is releasably secured to the holder by the movable cam 13. The cam 13 is moveable between a disengaged position and an engaged position. In the engaged position, the cam 13 exerts a force on the guide 12, thereby securing the guide 12 to the holder 11. In the disengaged position, the force exerted on the guide 12 by the cam 13 is relieved, allowing the guide 12 to be released from the holder 11.

This embodiment of the invention may further provide that the holder 11 includes a bottom member 21 and a pair of side members 22 that extend from the bottom member 21. A mounting member 23 serves as the mounting connection of the movable cam 13 to the holder 11. The mounting member 23 also connects the free ends of the side members 22 (i.e., the ends not connected to and located distally to the bottom member 21) to add structural stability to the holder 11.

In a typical embodiment, the side members 22 are substantially parallel to one another and extend upward from the bottom member. It will be understood that the term "substantially parallel" is meant to describe the spatial relationship between, for example, component to another component, wherein the relationship is approximately parallel.

In this arrangement, the mounting member 23 connects the top ends of the side members 22. The terms "bottom member," "upward," and "top ends" are intended to describe the typical orientation of the components of the holder 11, and are not intended to limit the invention to a single positioning. Those having ordinary skill in the art will recognize that the structure of the holder 11 can be formed in any orientation so long as the operation of the cam 13 releasably secures the guide 12 between the bottom member 21 and the mounting member 23.

Typically, the cam 13 of this particular embodiment includes a semi-circular engaging member 31 that pivotally mounts the cam 13 to the holder 11. The engaging member 31 has an outer radius that varies along an outer circumference of the engaging member 31, as is depicted in FIG. 4. Specifically, the outer radius varies from a first radius R1 that defines a disengaged position to a second radius R2 that defines an engaged position. The cam 13 also includes a lever arm 32 extending from a portion of the engaging member 31. Accordingly, movement of the lever arm 32 effects the rotation of the engaging member 31 between the disengaged position and the engaged position.

A wedge 14 may also be provided in a position between the cam 13 and the guide 12 such that the wedge 14 translates the rotation of the cam 13 between the disengaged position and engaged position to a compressive force securing the guide 12 to the holder 11. In other words, as the cam 13 is rotated, the thickness of the portion of the cam 13 between the mounting member 23 and the wedge 14 is changed. As the cam 13 is rotated towards the engaged position, the thickness of the portion of the cam 13 in contact with the wedge 14 increases, pressing the wedge 14 towards the guide 12. Alternatively, as the cam 13 is rotated toward the disengaged position, the thickness of the cam 13 relative to the wedge 14 decreases, relieving the compressive force of the wedge 14 against the guide 12.

To further assist in the securing and releasing of the guide 12 to the holder 11, the wedge 14 may define a varying thickness along its length, as is depicted in FIGS. 1 and 3. With such a structure, the wedge 14 may be positioned relative to the cam 13 such that guides of varying heights may be secured to the same holder 11 (e.g., a thicker portion of the wedge can more readily contact, and therefore exert pressure on, a smaller guide).

In another embodiment, the invention is a delivery guide assembly 10 for use in a rolling mill that includes a delivery stripper 12 releasably secured to a delivery holder 11 by a cam-style locking clamp 13. The rotation of the striker cam 13 imparts a compression force on the delivery stripper 12 to secure the delivery stripper 12 to the delivery holder 11. A base 15 supporting the delivery holder 11 and delivery stripper 12 may be included to secure the delivery guide assembly 10 in place.

The delivery holder 11 may be comprised of a bottom member 21, a pair of opposing side members 22 extending from the bottom member 21, and a striker cam mounting member 23 positioned between the opposing side members. Using a delivery holder 11 having this structure, the striker cam 13 engages the mounting member 23 to releasably secure the delivery stripper 12 to the delivery holder 11 within the space defined by the bottom member 21, the side members 22, and the striker cam mounting member 23. The delivery holder 11 may further include a top member 24 connecting the side members 22. The top member 24 should be substantially parallel with the striker cam mounting member 23 with respect to the bottom member 21, if not further from the bottom member 21. Such positioning ensures that the top member 24 does not interfere with the positioning of the delivery stripper 12 within the delivery holder 11. As noted above, the top member 24 provides stiffness to the delivery holder 11, and may further be used to connect other components in the rolling mill to the delivery guide assembly 10.

The delivery stripper 12 may be a one-piece component that is simply inserted and then secured to the delivery holder, as is shown in FIG. 2. Alternatively, the delivery stripper 12 may be constructed from multiple pieces. When using multi-piece strippers, the delivery holder 11 not only secures the delivery stripper 12 in place, but also secures the pieces of the delivery stripper 12 to each other. A variation of the delivery stripper constructed from two pieces is shown in FIG. 5.

The striker cam 13 may include a substantially semi-circular engaging member 31 for pivotally mounting the striker cam 13 to the delivery holder 11. The engaging member 31 has a variable outer radius, as shown in FIG. 4, ranging in thickness along its outer circumference from a first radius R1 defining a disengaged position to a second radius R2 defining an engaged position. The rotation of the striker cam 13 accordingly changes the thickness of the engaging member 32 relative to the delivery stripper 12, thereby exerting an increasing force on the delivery stripper 12 as the engaging member 31 rotates from the first radius R1 to the second radius R2.

One or more additional components may be included in the delivery guide assembly 10 to enhance the operation of the mechanism. First, a base 15 may be included to support the delivery holder 11 and the delivery stripper 12. The base 15 may be secured to other equipment in the rolling mill or to the ground below the delivery guide assembly 10 to provide structural support.

Second, a lever arm 32 attached to the cam-style locking clamp 13 can be provided to facilitate the securing and releasing of the delivery stripper 12. The inclusion of the lever arm 32 requires the operator of the delivery guide assembly 10 to apply less force to secure or release the delivery stripper 12 to the delivery holder 11. In some embodiments, the lever arm 32 extends beyond the delivery holder 11 to allow for easier access by the operator (i.e., the operator does not need to reach into the holder to manipulate the striker cam).

Third, a locking wedge 14 serving as an upper restraint for the delivery stripper 12 may be provided. The combination of a locking cam 13 and a locking wedge 14 serves to secure the delivery stripper 12 in place. As the locking cam 13 is moved to the engaged position, for instance by the movement of an attached lever arm 32, the interaction with the locking wedge 14 applies a force on the upper surface of the delivery stripper 12 and secures the stripper 12 to the delivery holder 11. The locking wedge 14 may be moveable with respect to the striker cam 13 such that the locking wedge 14 may engage the striker cam 13 at varying positions. Further, the thickness of the locking wedge 14 may vary along its length so that the positioning of the locking wedge 14 relative to the striker cam 13 can accommodate different sizes of delivery strippers 12.

Advantageously, the cam 13 and locking wedge 14 minimize the time required to remove the delivery stripper 12 for maintenance or replacement in case of cobbling, thus minimizing downtime in the mill. For example, a worker may strike the lever arm 32 of the cam 13 with a mallet to secure or release the wedge 14, thereby promoting the securing or removal of the delivery stripper 12. The action of striking the lever arm 32 is less time-consuming than loosening a bolt or striking a wedge multiple times to release or secure the delivery stripper 12.

Although this embodiment discloses the application of the invention to secure a delivery stripper to a holder, the structure and function of this embodiment is equally effective in securing an entry guide to a holder to guide a steel bar to a series of rollers in a steel mill.

In yet another embodiment, the invention is a delivery guide assembly 10 for use in a rolling mill having a delivery holder 11, a delivery stripper 12 releasably secured to the delivery holder 11, a base 15 supporting the delivery holder 11 and the delivery stripper 12, a locking wedge 14 positioned substantially adjacent to the delivery stripper 12 for restraining the delivery stripper 12 against the delivery holder 11, and a movable striker cam 13 having a lever arm 32 attached to the delivery holder 11. The striker cam 13 releasably engages the locking wedge 14 to secure the delivery stripper 12 to the delivery holder 11. In this embodiment, the rotation of the striker cam 13 facilitates the insertion or removal of the locking wedge 14, which in turn permits the securing or removal of the delivery stripper 12 to the delivery holder 11.

The striker cam 13 includes a substantially semi-circular engaging member 31 having an inner coupling surface engaging the delivery holder 11 and an outer surface engaging the locking wedge 14. The outer surface of the striker cam 13 may define a variable outer radius that varies along the outer circumference of the engaging member 31 from a first radius R1 to a second radius R2, the second radius R2 being greater than the first radius R1. The engagement of the striker cam 13 with the locking wedge 14 at the position of the outer surface having the first radius R1 defines a disengaged position. In this disengaged position, the locking wedge 14 may be removed from the delivery guide assembly 10, thereby releasing the delivery stripper 12. Conversely, the engagement of the striker cam 13 with the locking wedge 14 at the position of the outer surface having the second radius R2 defines an engaged position. In the engaged position, the combination of the striker cam 13 and the locking wedge 14 exert a pressure on the delivery stripper 12, securing the delivery stripper 12 against the delivery holder 11.

The delivery guide assembly of any of the embodiments of this invention can be formed from steel, alloy, or any other material suitable for the purposes of the invention as set forth herein.

In the drawings and specification, typical embodiments on the invention have been disclosed. Although specific terms have been employed, they have been used in a generic and descriptive sense only and not for purposes of limitation, the scope of the invention being set forth in the following claims.

The invention claimed is:

1. A guide assembly for use in processing a work piece comprising:

a holder;

a guide for directing a work piece from one station to another station, said guide releasably secured to said holder; and a moveable cam mounted on said holder, said moveable cam in a disengaged position releasing said guide from said holder, and said moveable cam in an engaged position securing said guide to said holder, said moveable cam comprising a substantially semi-circular engaging member for pivotally mounting said cam to said holder, said engaging member having an outer radius that varies along an outer circumference of said engaging member from a first radius defining the disengaged position to a second radius defining the engaged position; and a lever arm extending from said engaging member;

wherein movement of said lever arm effects the rotation of said engaging member between the disengaged position and the engaged position.

2. A guide assembly according to claim 1 wherein said holder comprising:

a bottom member;

a pair of side members extending from said bottom member, said side members substantially parallel to one another; and a mounting member connecting portions of said side members distally from said bottom member, said mounting member supporting said moveable cam;

wherein said guide is releasably secured between said bottom member and said mounting member.

3. A guide assembly according to claim 1 further comprising a locking wedge positioned substantially between said cam and said guide, said wedge translating rotation of said cam between the disengaged position and the engaged position.

4. A guide assembly according to claim 3 wherein said locking wedge defining varying thicknesses along its length.

5. A delivery guide assembly for use in a rolling mill comprising:

a delivery holder;

a delivery stripper releasably secured to said delivery holder; and a moveable striker cam mounted on said delivery holder, said striker cam releasably securing said delivery stripper to said delivery holder; said striker cam comprising a substantially semi-circular engaging member for pivotally mounting said striker cam to said delivery holder, said engaging member having a variable outer radius, said outer radius varying along the outer circumference of said engaging member from a first radius defining a disengaged position to a second radius defining an engaged position; and a lever arm extending from said engaging member;

wherein the rotation of said striker cam imparts a compression force on said delivery stripper to secure said delivery stripper to said delivery holder; and wherein the movement of said lever arm effects the rotation of said engaging member between said disengaged position and said engaged position.

6. A delivery guide assembly according to claim 5 wherein said delivery holder comprising:

a bottom member;

a pair of opposing side members extending from said bottom member; and a striker cam mounting member positioned between said opposing side members, said mounting member engaging said striker cam;

wherein said delivery stripper is releasably secured to said delivery holder within a space defined by said bottom member, said opposing side members, and said striker cam mounting member.

7. A delivery guide assembly according to claim 6 further comprising a top member connecting said side members, said top member positioned substantially parallel with said striker cam mounting member.

8. A delivery guide assembly according to claim 5 wherein said delivery stripper comprising one piece, said striker cam securing said one piece to said delivery holder.

9. A delivery guide assembly according to claim 5 wherein said delivery stripper comprising two or more pieces, said striker cam securing said two or more pieces together and to said delivery holder.

10. A delivery guide assembly according to claim 5 wherein said lever arm extends beyond said delivery holder.

11. A delivery guide assembly according to claim 5 further comprising a locking wedge positioned substantially between said striker cam and said delivery stripper, said locking wedge translating the movement of said striker cam to secure said delivery stripper to said delivery holder.

12. A delivery guide assembly according to claim 11 wherein said locking wedge is moveable to engage said striker cam and said delivery stripper at varying positions.

13. A delivery guide assembly according to claim 11 wherein said locking wedge defining varying thicknesses along its length.

14. A delivery guide assembly according to claim 5 further comprising a base supporting said delivery holder and said delivery stripper.

15. A delivery guide assembly for use in a rolling mill comprising:

a delivery holder;

a delivery stripper releasably secured to said delivery holder;

a base supporting said delivery holder and said delivery stripper;

a locking wedge positioned substantially adjacent to said delivery stripper and restraining said delivery stripper against said delivery holder; and a striker cam pivotally attached to said delivery holder, said striker cam comprising a substantially semi-circular engaging member having an inner coupling surface engaging said delivery holder and an outer surface engaging said locking wedge, said striker cam releasably engaging said locking wedge to secure said delivery stripper against said delivery holder, said striker cam having a lever arm;

wherein the rotation of said striker cam facilitates the insertion or removal of said locking wedge to thereby permit the securing or removal of said delivery stripper from the assembly.

16. A delivery guide assembly according to claim 15 wherein said outer surface defining a variable outer radius that varies along an outer circumference of said engaging member from a first radius to a second radius, said second radius greater than said first radius.

17. A delivery guide assembly according to claim 16 wherein the engagement of said striker cam with said locking wedge at the position of said outer surface having said first radius defines a disengaged position, and wherein the engagement of said striker cam with said locking wedge at the position of said outer surface having said second radius defines an engaged position.

18. A guide assembly for use in processing a work piece comprising:

a holder;

a guide for directing a work piece from one station to another station, said guide releasably secured to said holder; and a moveable cam pivotally attached to said holder, said moveable cam having a lever arm that extends beyond said holder, said moveable cam defining a substantially semi-circular engaging member having an outer surface defining a variable outer radius, said moveable cam in a disengaged position releasing said guide from said holder, and said moveable cam in an engaged position securing said guide to said holder.

* * * * *